US006567730B2

(12) United States Patent
Tanaka

(10) Patent No.: US 6,567,730 B2
(45) Date of Patent: May 20, 2003

(54) VEHICLE DIAGNOSIS SYSTEM

(75) Inventor: Ryo Tanaka, Nagoya (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 09/928,888

(22) Filed: Aug. 13, 2001

(65) Prior Publication Data

US 2002/0082755 A1 Jun. 27, 2002

Related U.S. Application Data

(63) Continuation-in-part of application No. 09/501,107, filed on Feb. 9, 2000, now abandoned, which is a continuation-in-part of application No. 09/000,545, filed on Dec. 30, 1997, now abandoned.

(30) Foreign Application Priority Data

Jan. 8, 1997 (JP) ..... 9-1390

(51) Int. Cl.[7] ..... H04Q 9/00; B60R 16/02; G05B 15/02; H04L 12/40

(52) U.S. Cl. ..... 701/33; 701/32

(58) Field of Search ..... 701/29, 32, 33

(56) References Cited

U.S. PATENT DOCUMENTS 5,058,044 A * 10/1991 Stewart et al. ..... 340/10.41
5,442,553 A * 8/1995 Parrillo ..... 455/420
5,781,871 A * 7/1998 Mezger et al. ..... 455/456
5,787,367 A * 7/1998 Berra ..... 380/28
6,175,934 B1 * 1/2001 Hershey et al. ..... 700/177

* cited by examiner

*Primary Examiner*—Michael J. Zanelli
(74) *Attorney, Agent, or Firm*—Muserlian, Lucas and Mercanti

(57) ABSTRACT

A vehicle diagnosis system which makes a diagnosis of a vehicle upon a fault or the like in accordance with various diagnosis data in the vehicle. In one embodiment, a diagnosis data collector is disposed in the vehicle for collecting data on various items of vehicle equipment. A radio communication device is also disposed in the vehicle. At the time of diagnosis, the radio device transmits diagnosis equipment to an external diagnosis device. Diagnosis data may be transmitted by radio, telephone, over the Internet or otherwise.

3 Claims, 12 Drawing Sheets

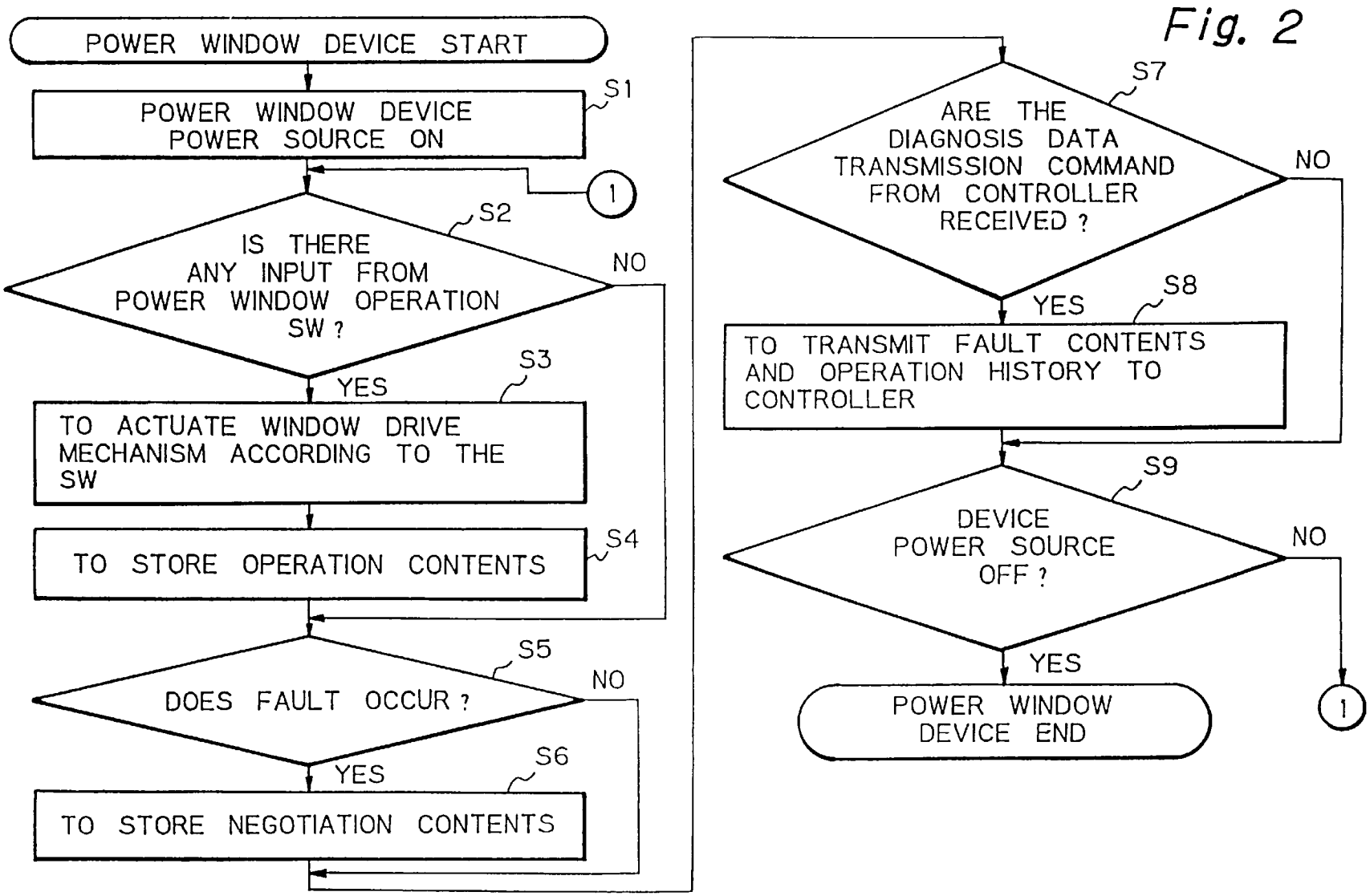
Fig. 2
POWER WINDOW DEVICE START
S1
POWER WINDOW DEVICE POWER SOURCE ON
1
S2
IS THERE ANY INPUT FROM POWER WINDOW OPERATION SW ?
NO
YES
S3
TO ACTUATE WINDOW DRIVE MECHANISM ACCORDING TO THE SW
S4
TO STORE OPERATION CONTENTS
S5
DOES FAULT OCCUR ?
NO
YES
S6
TO STORE NEGOTIATION CONTENTS
S7
ARE THE DIAGNOSIS DATA TRANSMISSION COMMAND FROM CONTROLLER RECEIVED ?
NO
YES
S8
TO TRANSMIT FAULT CONTENTS AND OPERATION HISTORY TO CONTROLLER
S9
DEVICE POWER SOURCE OFF ?
NO
YES
1
POWER WINDOW DEVICE END

VEHICLE DIAGNOSIS SYSTEM

CROSS-REFERENCES TO RELATED APPLICATIONS

This application is a continuation-in-part of application Ser. No. 09/501,107, filed Feb. 9, 2000, now abandoned, which is a continuation-in-part of application Ser. No. 09/000,545, filed Dec. 30, 1997, now abandoned, which claims a priority of Japanese Application 1390/97, filed Jan. 8, 1997. Such applications are incorporated herein by reference in their entirety.

BACKGROUND OF THE INVENTION

This invention relates to a vehicle diagnosis system, which makes a diagnosis of a vehicle upon a fault or the like in accordance with various diagnosis data in the vehicle.

For convenience of explanation, a typical example of conventional diagnostic systems will be described below by referring to the drawings. FIG. 8 is an explanatory view of a first prior art vehicle diagnosis system. FIG. 9 is an explanatory view of a second prior art vehicle diagnosis system.

In a typical example of the conventional vehicle diagnostic systems, as shown in FIG. 8, given vehicle 1 information is stored in a memory unit 2 in a vehicle 1, a connector in a single external unit 4 is connected to a connector 3 disposed on a given position in the vehicle 1, and the external unit 4 makes a diagnosis of a fault in the vehicle (for first prior art example, see Japanese Utility Model Public Disclosure No. HEI 2-8448 (1990)).

In the other typical example of the conventional vehicle diagnosis systems, as shown in FIG. 9, a connector 7 in a given wire communication device 6 instead of the single external unit 4 is connected to the connector 3 in 2 the vehicle 1 and the wire communication device 6 sends the data in the vehicle 1 to a given network 8 to make a diagnosis of a fault in the vehicle 1 (for second prior art example, see Japanese Patent Public Disclosure No. HEI 3-283842 (1991)).

In the above prior art, the external unit 4 or the wire communication device 6 is connected to the connector 3 in the vehicle 1. However, since there are in the vehicle 1 many dangerous devices for general users, it is very dangerous for the general user having no expert knowledge e to bring the connector 3 for diagnosis into connection with the external unit 4 or the wire communication device 6. Accordingly, the diagnosis connector 3 is usually disposed in an inner part of the vehicle 1. Consequently, it is not easy to connect the external unit 4 or the wire communication device 6 to the connector 3 in the vehicle 1. Although a user normally asks a skilled auto mechanic or other technical expert to make a diagnosis of a user's 1 vehicle, it is dangerous and troublesome for the technical expert. This requires considerable time in working, increases a user's waiting time for fault diagnosis and repairing, and incurs steep rises in the wages of the technical expert.

SUMMARY OF THE INVENTION

An object of the present invention is to provide a vehicle diagnosis system which can shorten the working time of a vehicle repair expert and ensure a user against risks.

In order to achieve the above object, a vehicle diagnosis system of the present invention comprises: a diagnosis data collector disposed in a vehicle for collecting given data on the vehicle equipment as data to be diagnosed through the vehicle network; a radio communication device disposed in the vehicle for at least transmitting the diagnosis data collected by the diagnosis data collector by means of a wireless manner; a controller for controlling the diagnosis data collector and the radio communication device; and an external diagnosis device disposed apart from the vehicle for receiving the diagnosis data transmitted in wireless mode from the radio communication device and diagnosing the vehicle in accordance with the diagnosis data.

The vehicle diagnosis system further comprises a time-clocking device. The controller may include a function of sending a command to the radio communication device to commence a radio transmission in accordance with clocking in the time-clocking device.

In the vehicle diagnosis system, the controller may include a function of sending a command to the radio communication device to commence a radio transmission in response to a signal from a given signaling device.

In the vehicle diagnosis system, the external diagnosis device may include a function of sending the result of the vehicle diagnosis to the radio communication device in the wireless. The radio communication device may include a function of receiving the result of the vehicle diagnosis sent in wireless mode from the external diagnosis device. The vehicle diagnosis system may be provided with a display for displaying the result information of the vehicle diagnosis received in wireless mode in the radio communication device.

The vehicle diagnosis system may further comprise an information concealable device for converting original signals corresponding to said diagnosis data collected in said diagnosis data collector into a given form of signals which any person except the person normally receiving it cannot understand. The external diagnosis device may include an information decoder for decoding the given form of signals converted from the diagnosis data sent from said radio communication device by the information concealable device into the original signals or given readable signals.

The information concealable device may utilize any one of passwords, fingerprint collating, voiceprint collating, eyeball blood vessel pattern collating, encipherment by means of a special operation, random numbers, coding decided beforehand between persons transmitting and receiving it, and passwords, operation and random numbers which change as time passes, or a combination of two or more of them.

Radio communication between the radio communication device disposed in the vehicle and the external diagnosis device may be carried out through a given large-scale network.

BRIEF DESCRIPTION OF THE DRAWINGS

FIG. 2 is a flowchart of an operation of vehicle equipment items such as a power window device in the first embodiment of the present invention;

DETAILED DESCRIPTION OF THE PREFERRED EMBODIMENTS

First Embodiment

<Construction>

Figure 1:
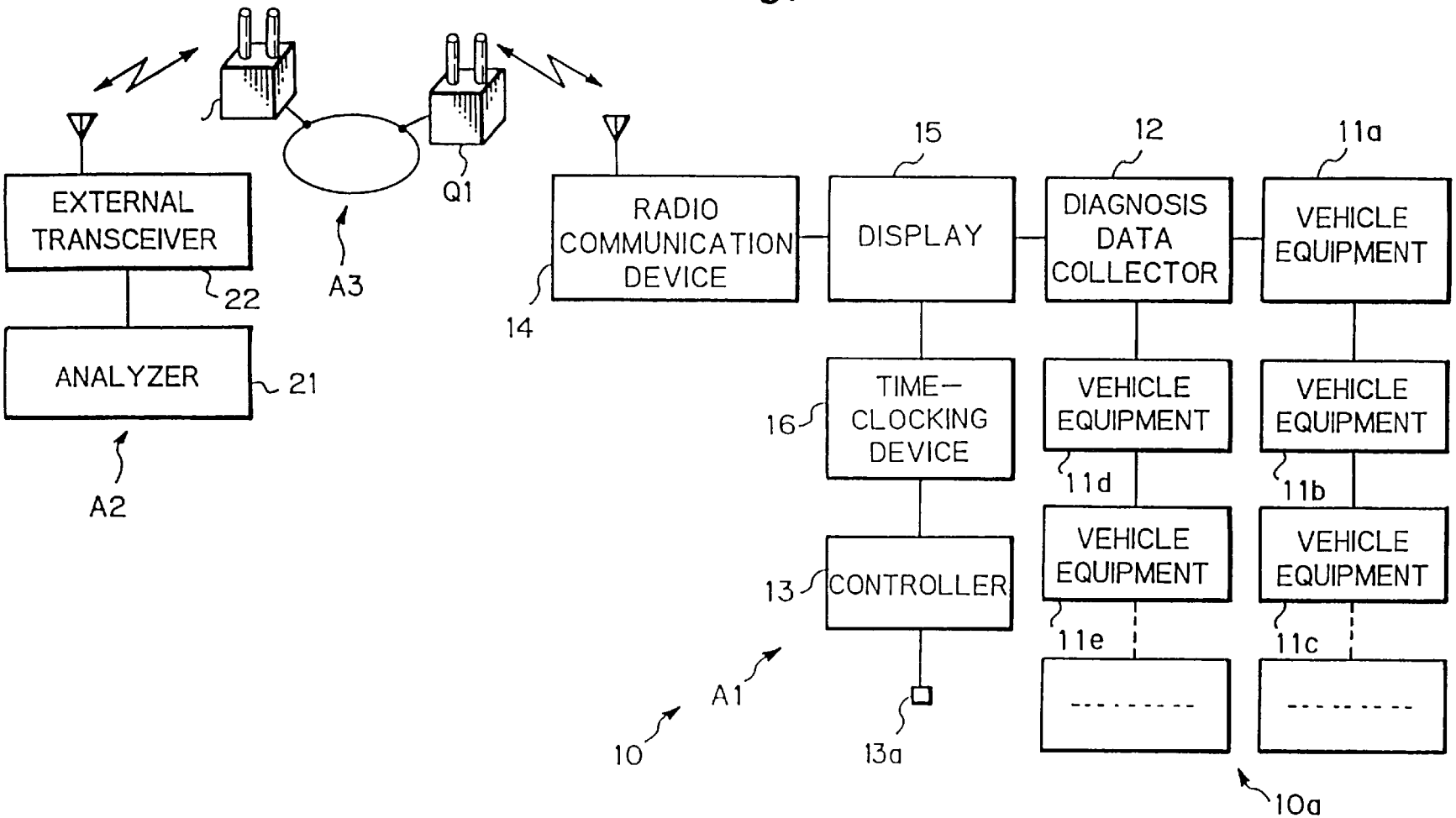
FIG. 1 is a block diagram of a first embodiment of a vehicle diagnosis system in accordance with the present invention.

FIG. 1 shows a first embodiment of a vehicle diagnosis system in accordance with the present invention. As shown in FIG. 1, the vehicle diagnosis system transmits data collected in a vehicle 10 to an external device by means of wireless communication without direct contact with the vehicle. This system includes a vehicle diagnosis section A1 disposed in the vehicle and an external diagnosis section A2 which is located at the outside of the vehicle and carries out a diagnostic work in accordance with wireless communication signals from the vehicle diagnosis section A1.

The vehicle diagnosis section A1 comprises: a plurality of items of vehicle equipment 11*a*, 11*b*, 11*c*, 11*d*, 11*e*, . . . disposed in the vehicle; a diagnosis data collector 12 which collects data (diagnosis data) necessary to make a diagnosis of the vehicle equipment 11*a*, 11*b*, 11*c*, 11*d*, 11*e* . . . and sends the data to a controller 13 described below; a controller 13 which controls the diagnosis data collector 12 and the like and stores diagnosis data collected by the collector 12; a radio communication device 14 which transmits in wireless mode the diagnosis data collected by the diagnosis data collector 12 and stored in the controller 13 to the external section A2 and receives in wireless mode diagnosis result information from the external diagnosis section A2; a time-clocking device 16 which controls a transmission timing of a diagnosis data transmission command generated by the controller 13 and a radio transmission timing from the radio communication device 14 to the eternal section A2; and a display connected to the controller 13.

The vehicle equipment items 11*a*, 11*b*, 11*c*, 11*d*, 11*e*, are, for example, a power window device, an automatic door lock device, an air conditioning device, a door mirror regulating device and the like, respectively. After these devices are grouped in compliance with a given layout, the grouped devices are interconnected in a pipe line configuration to form a given vehicle network a, which is connected to the diagnosis data collector 12. Each of the vehicle equipments includes an operation recording function which records its own operation contents, a fault recording function which records fault contents, and a data transmission function which transmits the operation contents and fault contents (diagnosis data) to the diagnosis data collector 12 in response to the command from the controller.

The diagnosis data collector 12 always collects the diagnosis data from the respective vehicle equipment items 11*a*, 11*b*, 11*c*, 11*d*, 11*e*, . . . and radio information received by the radio communication device 14 and always sends output signals to the controller 13, and sends the diagnosis data to the radio communication device 14 in response to the command from the controller 13.

The controller 13 is a microcomputer chip including a CPU, a ROM, and a RAM. The controller 13 includes a command function which sends a diagnosis data transmission command to the respective vehicle equipment item 11*a*, 11*b*, 11*c*, 11*d*, 11*e*, . . . to transmit the diagnosis data to the diagnosis data collector 12, a data storing function which stores in a storing device such as a RAM or the like the diagnosis data from the respective vehicle equipment items 11*a*, 11*b*, 11*c*, 11*d*, 11*e*, . . . , a data transmission instructing function which transmits in a wireless the stored diagnosis data through the radio communication device 14 to the external diagnosis section A2, and an information display function which displays the radio information received in the radio communication device 14 on the display 15.

The radio communication device 14 utilizes radio communication means which transmits and receives signals to and from a public base station Q1 of a public telephone circuit A (including an analog circuit and an ISDN circuit) such as a vehicle telephone, a portable telephone, a PHS (Personal Handy Phone System), and which transmits and receives signals by means of a given protocol.

On the other hand, the external diagnosis section A2, which is disposed in an automobile repairing factory or the like at each location, comprises an analyzer 21 which analyzes the diagnosis data from the vehicle diagnosis system A1 and an external transceiver 22 which receives signals transmitted in wireless from the vehicle diagnosis section A1 and transmits in wireless to the vehicle diagnosis section A1 signals which indicate analyzed results in the analyzer 21.

The analyzer 21 utilizes a general CPU to which the ROM, RAM, and the like are connected, and it is operated by a given software program contained in a given ROM or the like.

The external transceiver 22 utilizes a radio communication means which can transmit and receive data by means of the same protocol as that of the radio communication device 14 in the vehicle diagnosis section A1 described above. The external transceiver 22 transmits and receives signals to and from the vehicle diagnosis section A1 through the public base stations Q1 and Q2 and a public telephone circuit A3.

<Operation>

The operation of one embodiment of the vehicle diagnosis system disclosed above will be explained below. In this embodiment, it is assumed that collection of the diagnosis data by means of the diagnosis data collector 12 in the vehicle diagnosis section A1 is carried out at every periodical external transmission time and that radio communication from the vehicle diagnosis section A1 to the external diagnosis section A2 is carried out by means of periodical communication and manual operation of a user. It is also assumed that the radio communication device 14 utilizes a vehicle telephone and a dial-up connection of the vehicle telephone is used in communication connection from the vehicle diagnostic section A1 to the external diagnosis section A2.

In the vehicle diagnosis system, the diagnosis data including the operation contents during a usual operation and the fault contents upon fault are successively transmitted to the diagnosis data collector 12 and stored in the controller 13. An example of steps for operating a power window is shown in a flowchart in FIG. 2.

First, Step S1 starts the power window device corresponding to the vehicle equipment by switching the power source ON. Step S2 judges whether the power window device receives an output from a power window operation switch (SW), not shown. If the input is applied to the power window device, in Step S3, the power window drive mechanism is actuated in accordance with operation of the switch. At the substantially same time, operation contents are stored in the power window device (Step S4).

If there is a fault in a part of the power window drive mechanism, Step S judges whether any fault occurs in the power window device. If it is judged that the fault occurs therein, the fault contents are stored in the power window device (Step S6).

The diagnosis data transmission command is transmitted from the controller and Step S7 judges whether the power window device receives the diagnosis data transmission command. If it is judged that the device receives the command, in Step S8 the operation contents and fault contents are collected by the diagnosis data collector 12 and the collected data are sent to the controller 13. Thereafter, the operations which follow the Step S2 are repeated until the power source of the power window device turns ON (Step S9).

Figure 3:
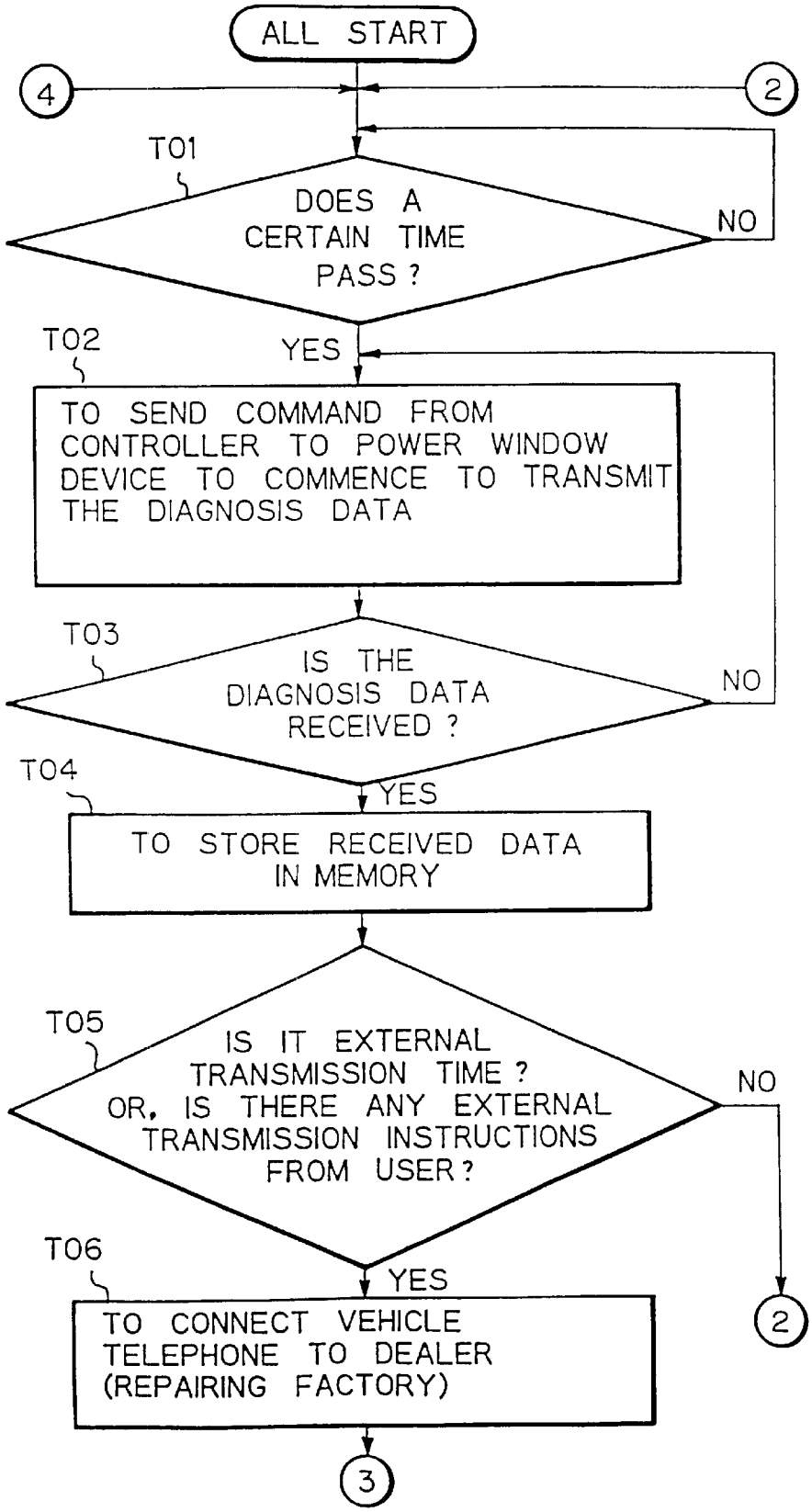
FIG. 3 is a flowchart of an operation of the first embodiment of the vehicle diagnosis system in accordance with the present invention.
Figure 4:
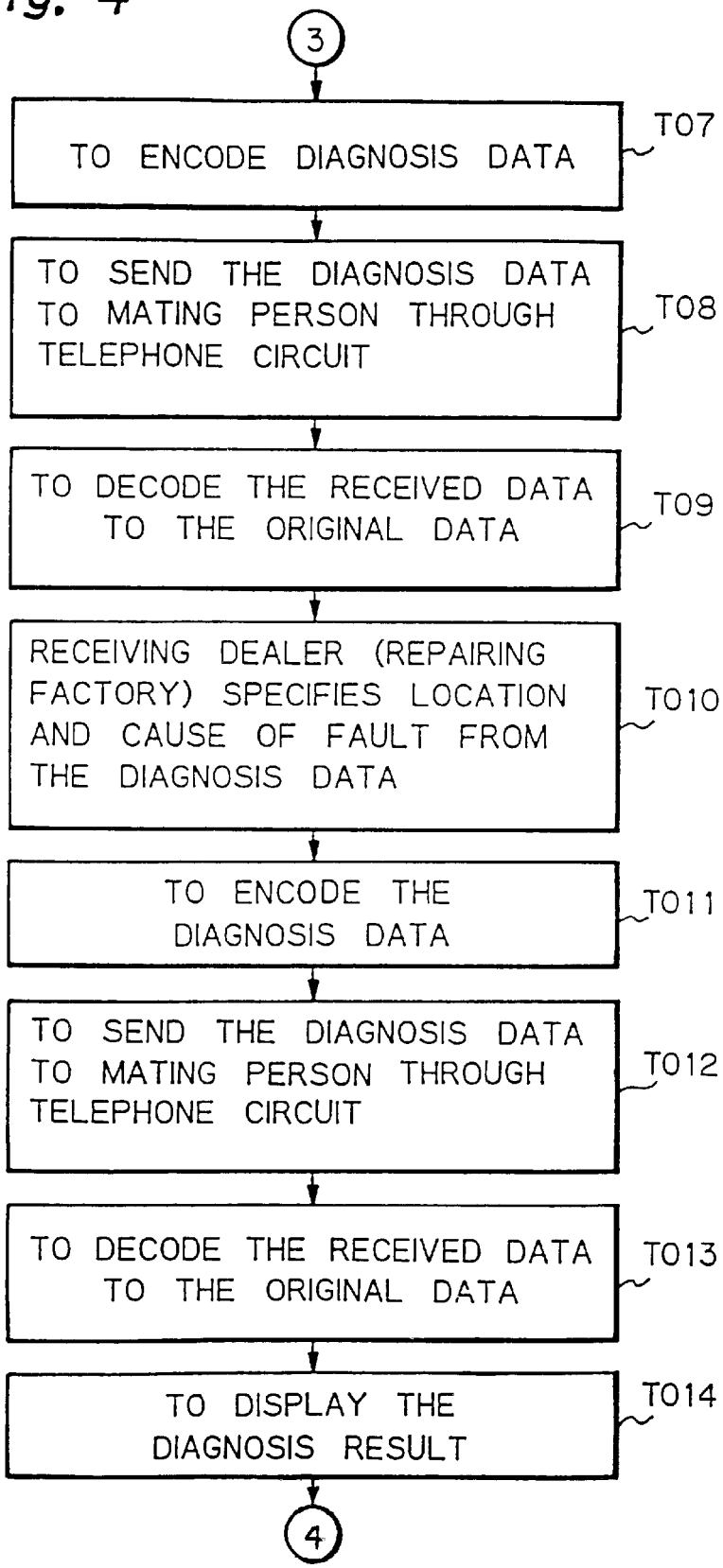
FIG. 4 is a flowchart of an operation of the first embodiment of the vehicle diagnosis system in accordance with the present invention.

Next, steps which transmits in a wireless the diagnosis data collected in the vehicle diagnosis section A1 to the external diagnosis section A2 will be explained below by referring to the flowcharts shown in FIGS. 3 and 4.

First, Step T01 judges whether a certain period in time after an actuation time of the vehicle diagnosis system or a previous data collecting time passes on the basis of clocking in the time-clocking device 16 and whether such timing is suitable for collection of the diagnosis data. If it is judged that the timing is suitable, the diagnosis data transmission command is sent through the diagnosis data collector 12 to the power window device in Step T02. If the diagnosis data is sent from the power window device to the controller 13 (Step T03), the received diagnosis data are stored in the controller 13 by its data storing function (Step T04).

Step T05 detects whether a periodical external 1 transmission time comes in accordance with clocking in the time-clocking device 16 or whether a user instructs external transmission by manually pushing a given push button 13*a*. If both operations are not detected, the operations from Step T01 are repeated again.

On the other hand, if either operation can be detected, Step T06 carried out dial-up connection to the external diagnosis section A2, that is, a repairing factory at each location by means of a vehicle telephone corresponding to the radio communication device 14.

Step T07 encodes the diagnosis data by means of the controller 13. Step T08 transmits in the wireless the encoded diagnosis data from the radio communication device 14. The encoded diagnosis data are transmitted to the external transceiver 22 in the external diagnosis section A2 such as each repairing factory or the like through the public base stations Q1 and Q2 predeterminately disposed at every location and the public telephone circuit A3.

Step T09 decodes the received diagnosis data in the external diagnosis section A2. In Step T, the analyzer 21 specifies the fault location and cause in the vehicle. Step T11 encodes information about the diagnosis result and transmits it in the wireless by means of the external transceiver 22. The encoded information concerning the diagnosis result is sent to the radio communication device 14 in the vehicle diagnosis section A1 through the public base stations Q1 and Q2 and the public telephone circuit A3 (Step T12).

Figure 5:
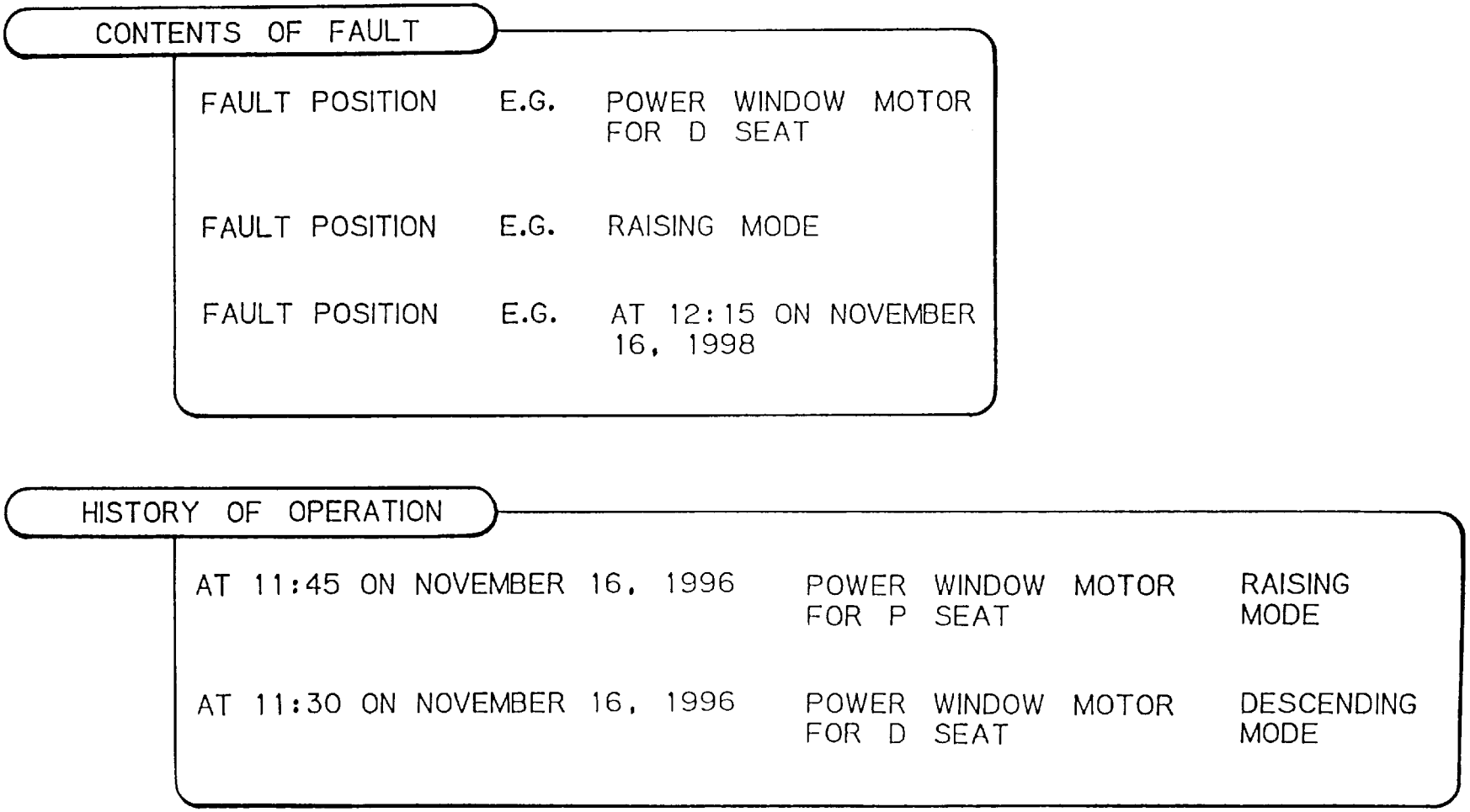
FIG. 5 is a front view of a display in the first embodiment of the vehicle diagnosis system of the present invention, illustrating an example of a displayed picture.

Again, Step T13 decodes the information concerning the diagnosis result received by the controller 13 in the vehicle diagnosis section A1 and in Step T14 the diagnosis result is displayed on the display 1. An example of display at this time is shown in FIG. 5. Thereafter, the operations from Step T01 are repeated.

Thus, since all of the diagnosis data in the vehicle are collected in the diagnosis data collector 12 and stored in the controller 13 and these data are transmitted to the external diagnosis section A2 by means of the radio communication device 14, it is not necessary to connect the special device to the connector in the vehicle as effected in the prior art and thus labor of work can be greatly reduced.

Also, since it is not necessary to come into contact with the vehicle directly to make a diagnosis, there is no fear that a person inadvertently touches any dangerous devices.

In addition, if the external diagnosis device is operated for 24 hours so that the diagnosis data are received automatically, a user needs not bring the vehicle to the factory and thus the waiting time can be shortened. It is possible in the factory side to save a time for diagnosis preparation, to reduce an actual working time, and to lower a technical cost such as wages or the like.

Second Embodiment

Figure 6:
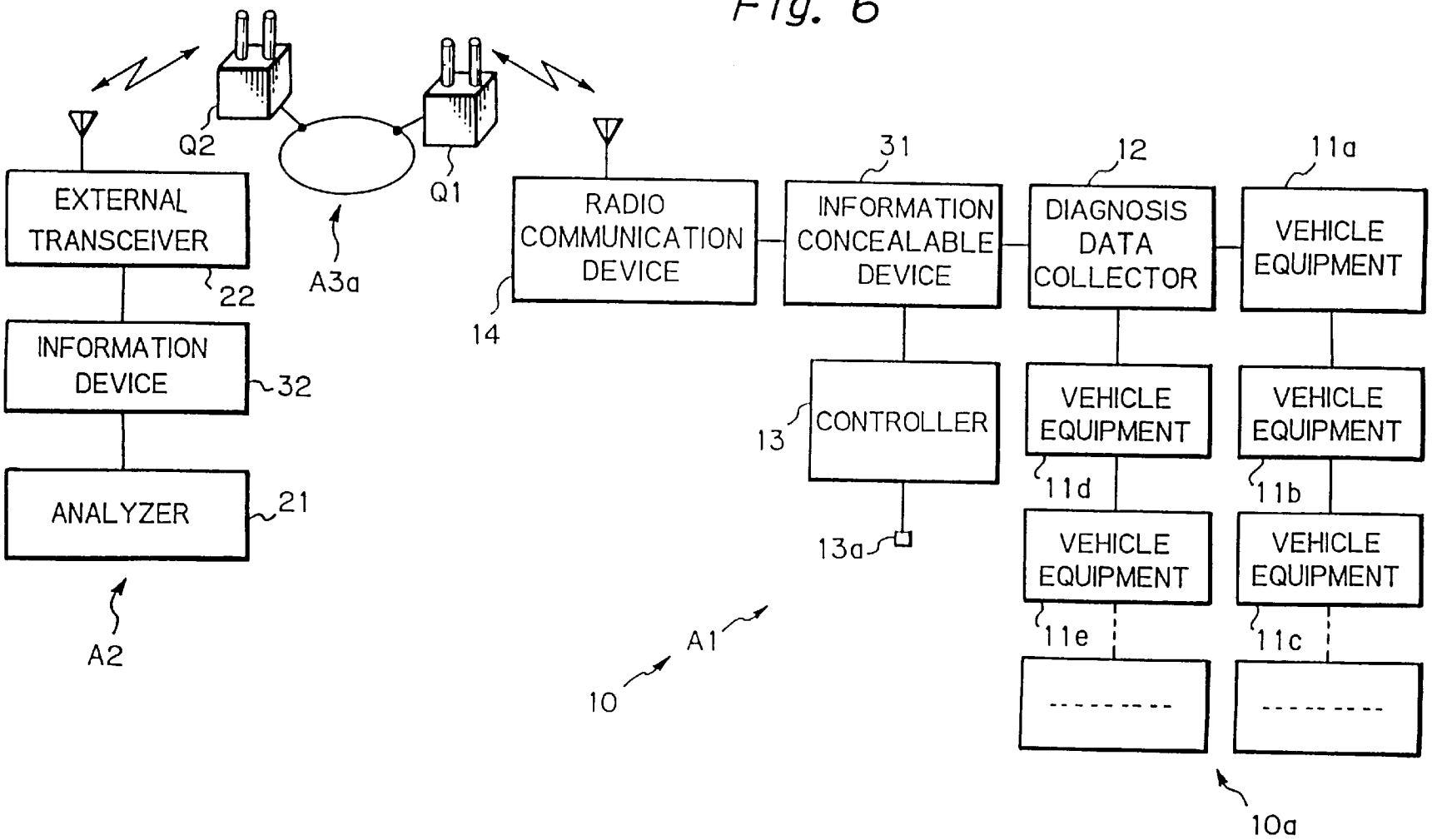
FIG. 6 is a block diagram of a second embodiment of the vehicle diagnosis system in accordance with the present invention.

FIG. 6 is a block diagram of a second embodiment of the vehicle diagnosis system in accordance with the present invention. The same elements of the second embodiment shown in FIG. 6 as those of the first embodiment shown in FIG. 1 are indicated by the same signs. As shown in FIG. 6, the second embodiment of the vehicle diagnosis system is directed to an example or one way communication from the vehicle diagnosis section A1 to the external diagnosis section A2. In particular, this system handles numerical information such as a type of Internet protocol (IP) or the like as a medium for radio communication between the vehicle diagnosis section A1 and 2 the external diagnosis section A2. The system may utilize a large scale network such as an Internet A3*a* or the like as the medium.

After the diagnosis data are converted into the numerical information in the vehicle diagnosis section A1 in the vehicle diagnosis system, radio signals transmitted in the wireless from the radio communication device 14 are received in the first public base station Q1, are transmitted to the second public base station Q2 via a given network (internet or the like) A3 including the public telephone circuit, and are sent through the external transceiver 22 in the external diagnosis section A2 to the analyzer 21.

Accordingly, whenever the public base stations Q1 and Q2 are provided, it is possible to readily effect vehicle diagnosis in a world scale.

In this case, the radio communication device 14 can utilize, for example, a public telephone circuit (including an analog circuit and an ISDN circuit) such as a vehicle telephone, a portable telephone, a PHS, or the like.

However, in the case of transmitting and receiving numerical information via the large scale network described above, it is important to take into consideration of security in order to protect the information against any network crime such as an illegal data-peeping action by the third person, a data breakage by the third person, or the like. Accordingly, this embodiment makes it difficult that the third person does the illegal peeping action, by providing in the vehicle diagnosis section A1 on the transmission side an information concealable device 31 which converts the original signals corresponding to the diagnosis data into a given form which cannot be understood by any person except the person receiving it and by providing in the external diagnosis section A2 on the receiving side an information decoding device 32 which decodes the diagnosis data transmitted in the wireless into the original signals or given readable signals.

As an information concealing method which is used in the information concealable device 31 and information decoding device 32, any one of a conventional enciphering method which utilizes the same key upon enciphering and decoding of information and an open key enciphering method which utilizes different keys upon enciphering and decoding of information or a combination of them are preferable.

The display (15) in the vehicle diagnosis section A1 described above in connection with the first embodiment is omitted in the second embodiment, since it is assumed in the second embodiment that the one way communication is effected from the vehicle diagnosis section A1 to the external diagnosis section A2. In particular, since the radio transmission is carried out from the radio communication device 14 by a selectable action in which the user selectively pushes the push button 13*a* or the 2 like, the diagnosis data are not transmitted in the wireless periodically. Accordingly, the time-clocking device (16) explained above in the first embodiment is omitted in the second embodiment. Since the other constructions are the same as those of the first embodiment, they are not explained here.

The second embodiment can obtain the same effect as that of the first embodiment. Further, in the second embodiment, even if the vehicle moves far away from the repairing factory which makes a diagnosis of the vehicle, for example in the case where a user takes the vehicle abroad to live there, or in the case where the user goes on a drive by the vehicle, the user can transmit the diagnosis data through the large-scale network to the repairing factory. In addition, it is possible to ensure to protect the user's privacy by preventing the crime action such as the illegal data-peeping action or the like by means of the communication through the large-scale network.

Third, Fourth, Fifth and Sixth Embodiments

Figure 6A:
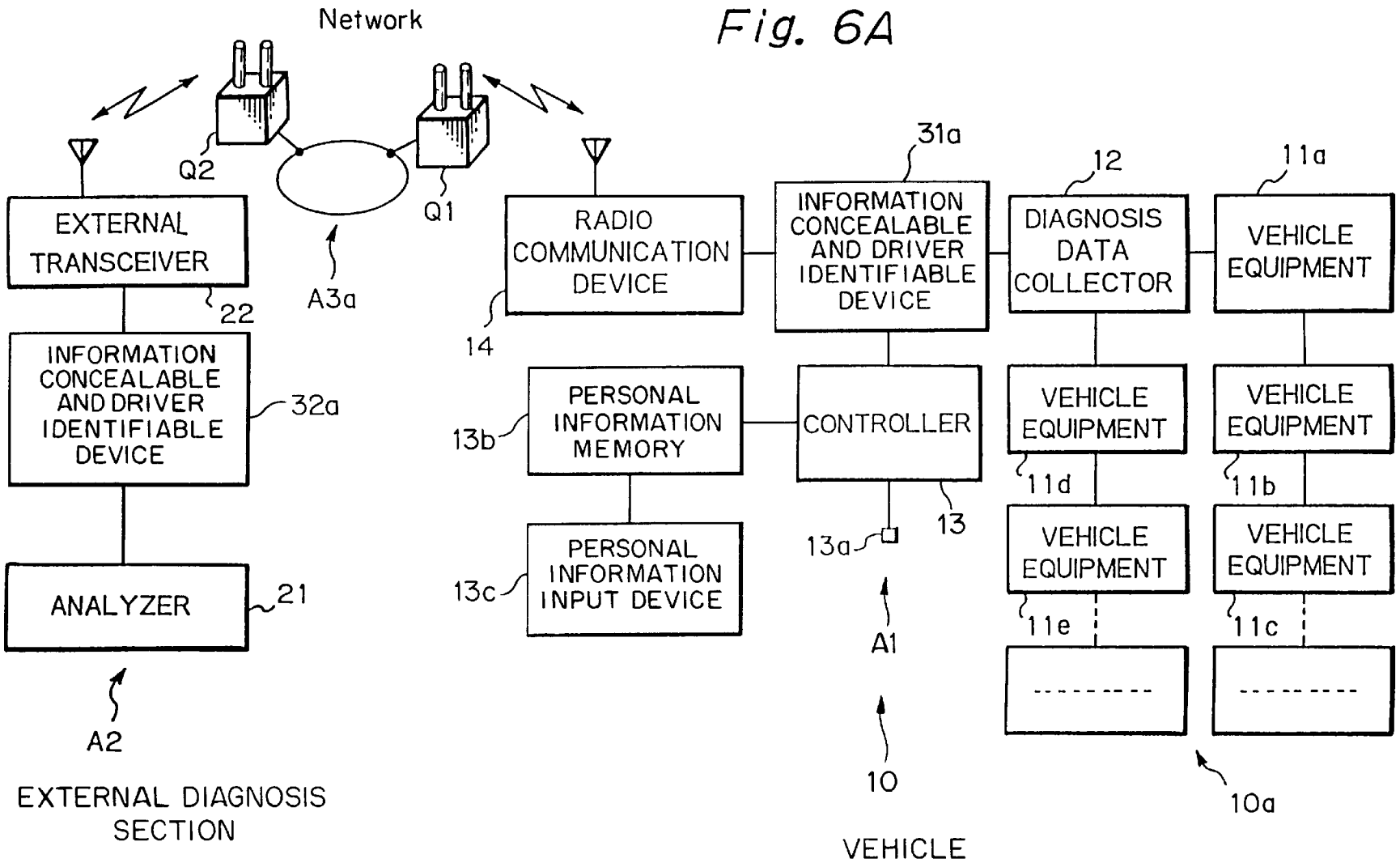
FIG. 6A is a block diagram of a third embodiment of the vehicle diagnosis system in accordance with the present invention.
Figure 6B:
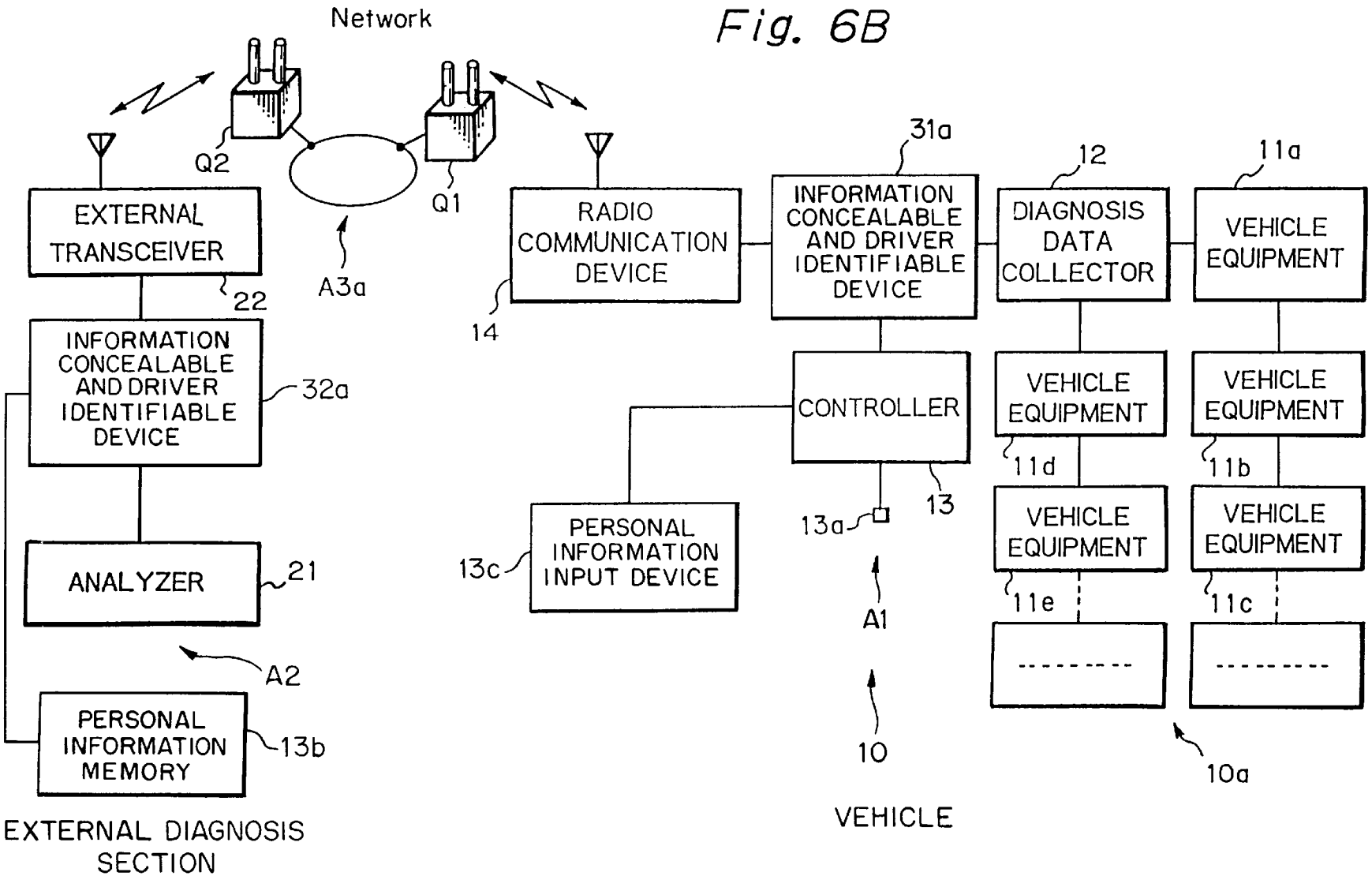
FIG. 6B is a block diagram of a fourth embodiment of the vehicle diagnosis system in accordance with the present invention.
Figure 6C:
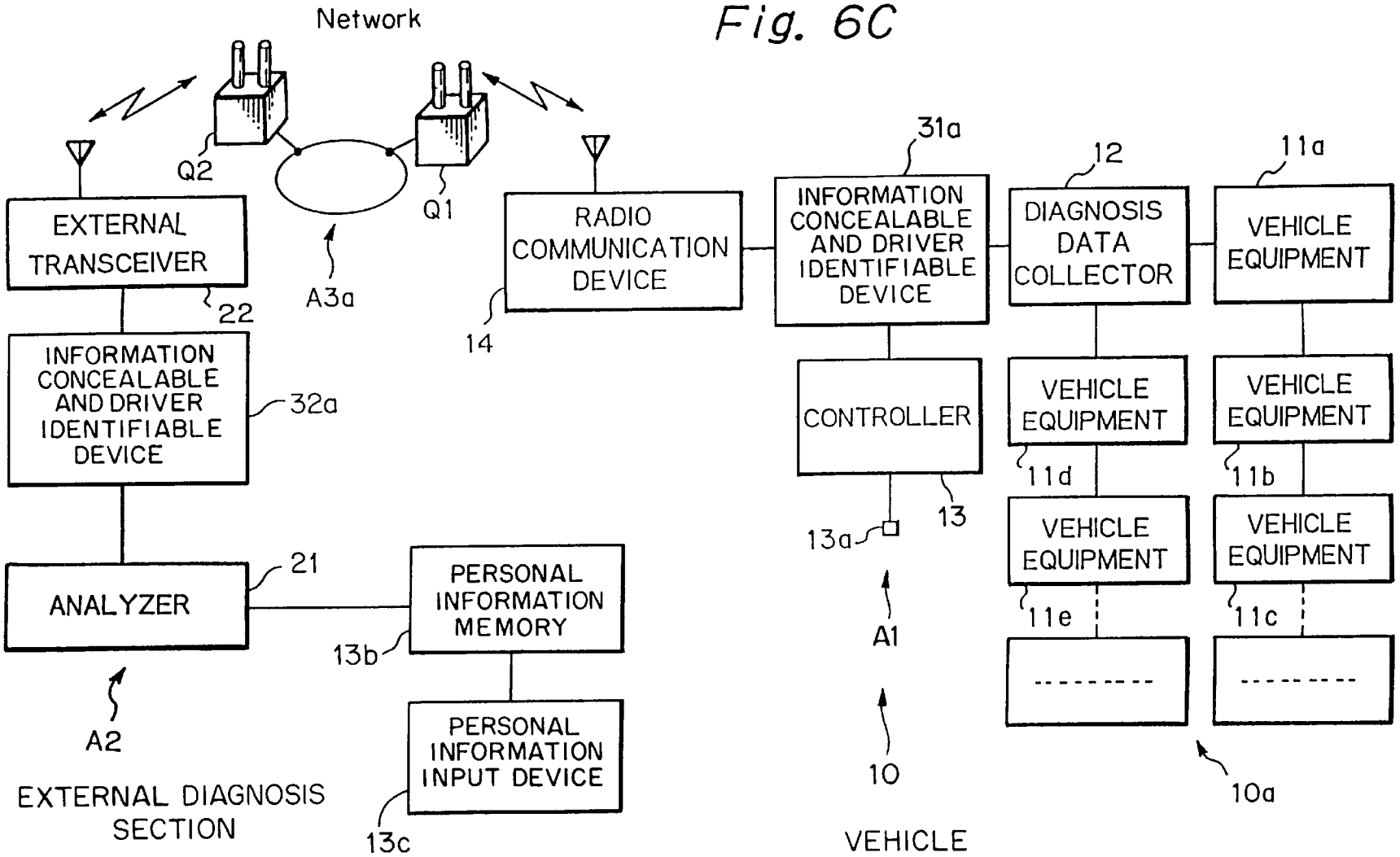
FIG. 6C is a block diagram of a fifth embodiment of the vehicle diagnosis system in accordance with the present invention.

The third through fifth embodiments of the invention are shown in FIGS. 6A through 6C, and are modifications of the second embodiment shown in FIG. 6. The information concealable device 31 in the vehicle and information device 32 in the external diagnosis device A2 shown in FIG. 6 may be modified to a first information concealable and driver identifiable device 31*a* in the vehicle, and a second information concealable and driver identifiable device 32*a* in the external diagnosis device A2, respectively. A personal information memory 13*b* is also included, either in the vehicle 10 (see FIG. 6A) or in the external diagnostic unit A2 (see FIGS. 6B and 6C).

The third, fourth and fifth embodiments serve to prevent against network crime and burglary of the vehicle and to protect personal data. Personal data may include a personal name, a personal code number, insurance data, passwords, fingerprints, voiceprints, eyeball blood vessel patterns, credit cards, operation histories, or the like. Such personal data are stored in the personal information memory 13*b*, and are entered into the memory through a personal information input device 13*c*, which may include a keyboard, a voice input device, card reader, or the like.

Figure 10:
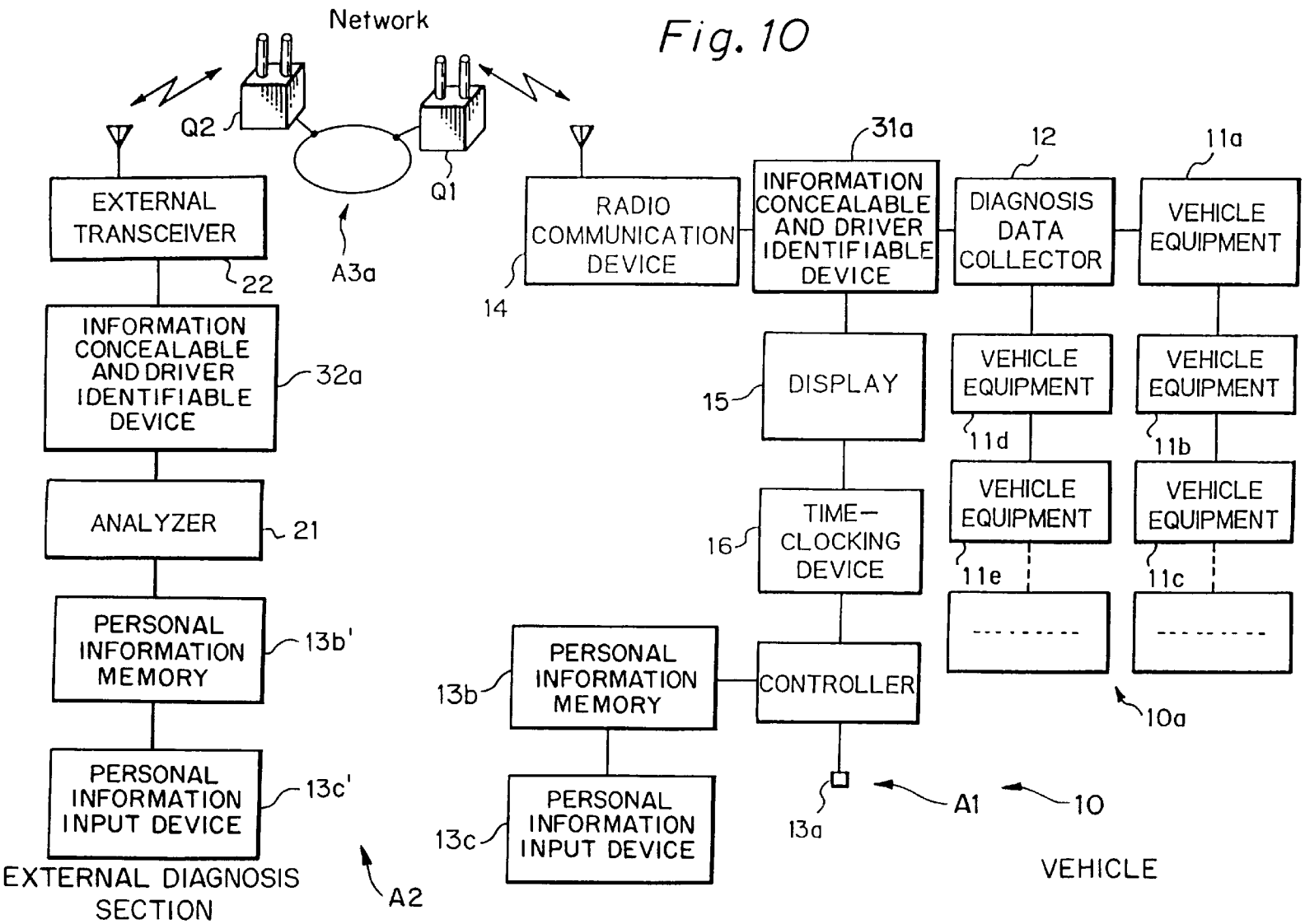
FIG. 10 is a block diagram of a sixth embodiment of the vehicle diagnosis system in accordance with the present invention.

The sixth embodiment of the invention is shown in FIG. 10, and is a modification of the fifth embodiment shown in FIG. 6C. It should be noted that the external diagnosis section A2 does not always repair a fault or the like in a vehicle. In other words, a car owner may request another engineering shop to repair the fault in the car in accordance with the diagnosis data obtained from the external diagnosis section A2. Accordingly, it is necessary to make a history of the timing of previously collected and previously transmitted diagnosis data by using the time-clocking device 16 in the vehicle diagnosis section A1. Further, it is also necessary to protect personal private data and ensure security in business by utilizing the information concealable and driver identifiable devices 31*a* and 32*a*, personal information memories 13*b* and 13*b*', and personal information input devices 13*c* and 13*c*' in the vehicle diagnosis sections A1 and A2, respectively.

ALTERNATIVE EXAMPLES

Figure 7:
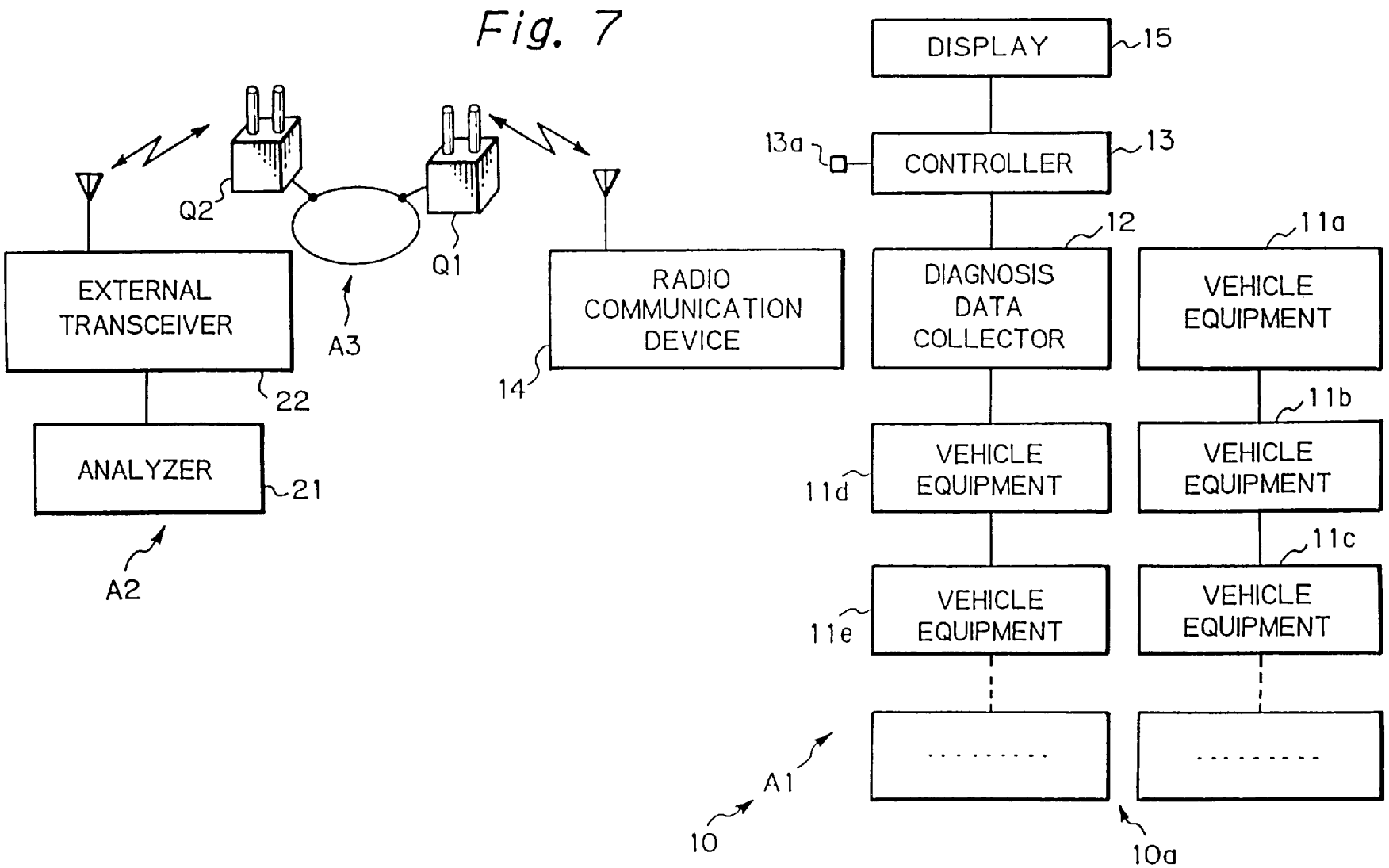
FIG. 7 is a block diagram of an alteration of the vehicle diagnosis system in accordance with the present invention.
Figure 8:
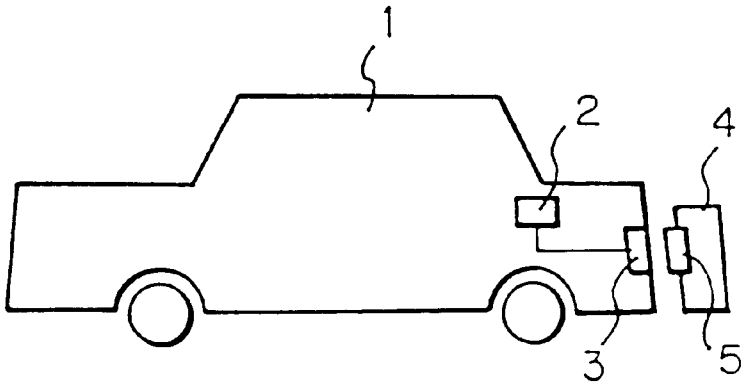
Fig. 8 PRIOR ART
FIG. 8 is an explanatory view of a first prior vehicle diagnosis system.
Figure 9:
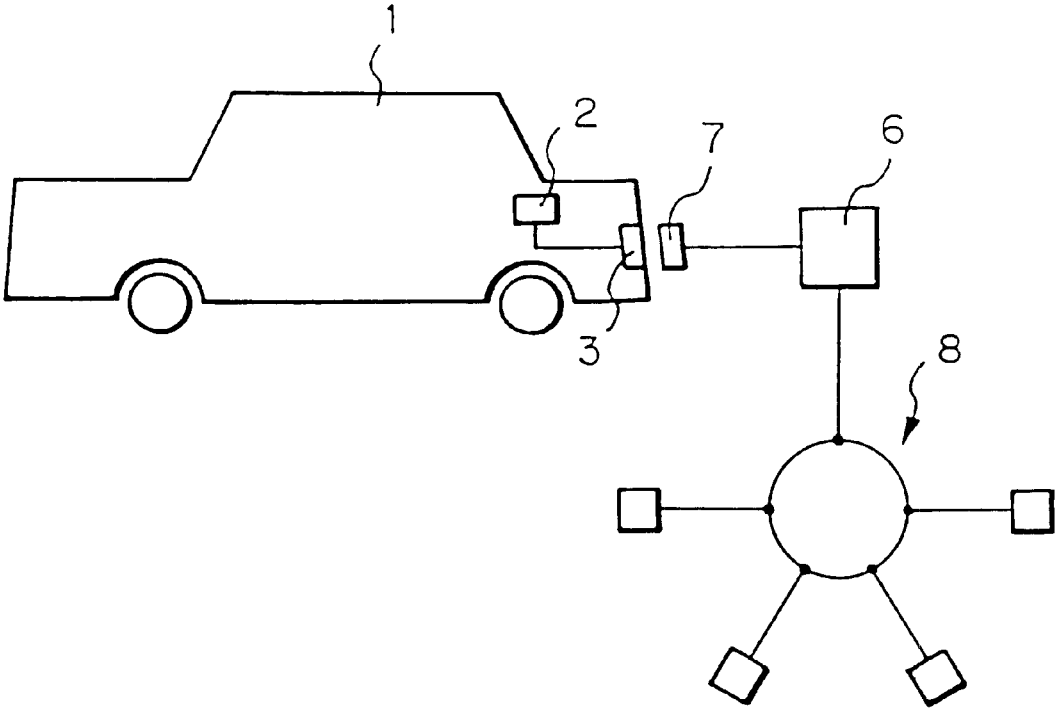
Fig. 9 PRIOR ART
FIG. 9 is an explanatory view of a second prior vehicle diagnosis system.

The diagnosis data may be transmitted from the radio communication device 14 to the external diagnosis section A2 when a user pushes the given push button 13*a*, although the diagnosis data are transmitted from the radio communication device 14 to the external diagnosis section A2 in accordance with clocking in the time-clocking device 16. FIG. 7 shows a schematic construction of the vehicle diagnosis system in this case. The controller 13 is directly connected to the diagnosis data collector 12 and thus the time-clocking device 16 described in the first embodiment is omitted in FIG. 7.

Also, in the first embodiment, one-way communication is effected from the vehicle diagnosis section A1 to the external diagnosis section A2 and the display 15 on the side of the vehicle diagnosis section A1 may be omitted. Further, in the second embodiment, bidirectional communication may be effected between the vehicle diagnosis section A1 and the external diagnosis section A2 and the display 1 may be provided in the vehicle diagnosis section A1.

Only a single vehicle equipment item may be connected through the vehicle network 10*a* to the diagnosis data collector 12, although the plural vehicle equipment items 11*a*, 11*b*, 11*c*, 11*d*, 11*e*, . . . are connected to the vehicle network 10*a* in the respective embodiments.

The radio communication device may utilize other electric wave communication means such as a portable telephone, a service wireless device, an infrared communication means, an optical communication means, or the like, although the radio communication device utilizes the vehicle telephone in the respective embodiments.

Although the second embodiment utilizes the conventional enciphering method, the open key enciphering method, or the like as the information concealing method used in the information concealable device 31 and information decoding device 32, the information concealing method may utilize any one of passwords, fingerprint collating, voiceprint collating, eyeball blood vessel pattern collating, encipherment by means of a special operation, random numbers, coding decided beforehand between a person on a transmitting side and a person on a receiving side, and passwords, operation and random numbers which change as time passes, or a combination of two or more of them.

According to the present invention, it is possible to eliminate a requirement for connecting the special device to the connector in the vehicle and to greatly reduce labor required, since the diagnosis data in the vehicle are collected by the diagnosis data collector and are transmitted in the wireless to the external diagnosis section by means of the radio communication device. There is no fear for a person to touch any dangerous devices inadvertently, since the person need not come contact with the vehicle directly to make a diagnosis. Further, if the external diagnosis device is operated for 24 hours so that the device can receive the diagnosis data automatically, a user need not take the vehicle to the factory to diagnose it, thereby eliminating moving time and waiting time. It is also possible on the factory side to save time for preparing the diagnosis, thereby reducing an actual working time and lowering technical labor costs or the like.

It is also possible to greatly reduce the labor required for a periodical diagnosis of the vehicle, since the 2 instructions for wireless communication is given to the radio communication device by the controller in accordance with the clocking in the time-clocking device.

It is possible for a user to send the diagnosis data to make a diagnosis of the vehicle if desired, since the diagnosis data are transmitted by the user's instructions.

It is possible on the vehicle diagnosis side to see the result diagnosed on the external diagnosis section side and to rapidly inform the diagnosis result to the user.

It is possible to prevent a crime action such as illegal data-peeping action or the like, thereby assuring a protection of privacy for the user, since the information concealable means is provided in the vehicle on the transmission side, this information concealable means converts the original signals corresponding to the diagnosis data into the given form which cannot be understood by any person except the regular person receiving it, and it is decoded by the information decoding means on the receiving side, namely the external diagnosis section side.

The user can transmit the diagnosis data through the large-scale network to the repairing factory, even if the vehicle moves far away from the repairing factory. This makes possible a diagnosis of the vehicle, for example, in the case where the user goes on a drive by the vehicle, or in the case where the user takes the vehicle abroad to live there, since the radio communication between the radio communication device disposed in the vehicle and the external diagnosis section is carried out through the given large-scale network.

The entire disclosure of Japanese Patent Application No. 9-1390 filed on Jan. 8, 1997 including specification, claims, drawings and summary is incorporated herein by reference in its entirety.

What is claimed is:

1. A vehicle diagnosis system, comprising:

one or more items of vehicle equipment (11*a*–11*e* . . . ) connected to a vehicle network;

a diagnosis data collector (12) disposed in a vehicle (10) for collecting given data on said vehicle equipment items (11*a*–11*e* . . . ) as data to be diagnosed through said vehicle network;

a radio communication device (14) disposed in the vehicle for at least transmitting said diagnosis data collected by said diagnosis data collector (12) and first driver information data from a first personal information input device (13*c*) and a first personal information memory (13*b*) disposed in the vehicle (10) by wireless means (A3*a*);

a controller (13) disposed in the vehicle for controlling said diagnosis data collector (12) and said radio communication device (14);

an external diagnosis device (21, 22) disposed apart from the vehicle (10) for receiving said diagnosis data and said first driver information data transmitted by wireless means (A3*a*) from said radio communication device (14) to diagnose the vehicle in accordance with said diagnosis data and to identify a driver in accordance with said first driver information data and second driver information data from a second personal information input device (13*c*') and a second personal information memory (13*b*') disposed in said external diagnosis device (21, 22);

a first information concealable and driver identifiable device (31*a*) disposed in the vehicle for converting original signals corresponding to said diagnosis data collected in said diagnosis data collector (12) and said first driver information data into a given form of signals which any person except a regular receiving person cannot understand and for decoding a given form of signals converted from said second driver information data sent from said external diagnosis device (21, 22);

a second information concealable and driver identifiable device (32*a*) disposed in said external diagnosis device (21, 22) for decoding said given form of signals converted from said collected diagnosis data and said first driver information data sent from said radio communication device (14) by said first information concealable and driver identifiable device (31*a*) into the original signals or readable signals from the second information concealable and driver identification device (32*a*) and for converting original signals corresponding to said diagnosed data and said second driver information data into a given form of signals which any person except a regular receiving person cannot understand; and a time-clocking device (16) disposed in the vehicle for judging whether a certain period of time after an actuation time of the vehicle diagnosis system or a previous data collecting time has passed to a make a history of the timing of previously-collected and previously-transmitted diagnosis data and for judging whether timing is suitable for said collection and transmission of said diagnosis data.

2. A vehicle diagnosis system according to claim 1, wherein said first information concealable and driver identifiable device is connected to said controller in the vehicle and said first personal information input device is connected through said first personal information memory to said controller in the vehicle.

3. A vehicle diagnosis system according to claim 2, wherein said second personal information input device is connected through a second personal information memory to said second information concealable and driver identifiable device in said external diagnosis device.

* * * * *